US010405383B2

(12) United States Patent
Van Kaathoven et al.

(10) Patent No.: US 10,405,383 B2
(45) Date of Patent: Sep. 3, 2019

(54) METHOD OF CONTROLLING A LIGHTING ARRANGEMENT, A LIGHTING CONTROL CIRCUIT AND A LIGHTING SYSTEM

(71) Applicant: SIGNIFY HOLDING B.V., Eindhoven (NL)

(72) Inventors: Dirk Jan Van Kaathoven, Eindhoven (NL); Theo Gerrit Zijlman, Tilburg (NL); Marcel Van Der Ham, Eindhoven (NL); Lambertus Adrianus Marinus De Jong, Son (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/086,693

(22) PCT Filed: Apr. 4, 2017

(86) PCT No.: PCT/EP2017/057988
§ 371 (c)(1),
(2) Date: Sep. 20, 2018

(87) PCT Pub. No.: WO2017/182266
PCT Pub. Date: Oct. 26, 2017

(65) Prior Publication Data

US 2019/0110343 A1 Apr. 11, 2019

(30) Foreign Application Priority Data

Apr. 22, 2016 (EP) ..... 16166560

(51) Int. Cl.
*H05B 33/08* (2006.01)

(52) U.S. Cl.
CPC ..... *H05B 33/0815* (2013.01); *H05B 33/086* (2013.01); *H05B 33/0827* (2013.01); *H05B 33/0845* (2013.01)

(58) Field of Classification Search
CPC ..... H05B 3/0827; H05B 33/0857; H05B 33/0818; H05B 33/086; H05B 33/0869;
(Continued)

(56) References Cited

U.S. PATENT DOCUMENTS 7,926,300 B2 * 4/2011 Roberts ..... G09G 3/3413 362/227
8,067,898 B2 * 11/2011 Radermacher ..... H05B 33/0815 315/185 R
(Continued)

FOREIGN PATENT DOCUMENTS

CN 103596336 A 2/2014
DE 102012203746 A1 6/2013
(Continued)

*Primary Examiner* — Haissa Philogene

(57) ABSTRACT

A lighting control circuit is for controlling a lighting arrangement comprising a set of at least two light sources in parallel. A current driver is used to deliver a drive current to the lighting arrangement. A switch is associated with the second light source, which may for example be provided for color adjustment, and the duty cycle of the switch is controlled as well as the overall drive current setting thereby to control the color or color temperature setting and dimming level of the lighting arrangement. The controller derives the required average output current and the expected average output voltage from the current driver based on the determined duty cycle and the dimming level, and then derives the current driver setting. In this way, the current driver is accurately controlled to deliver the required output. This enables a single stage driver to be used to control the color or color temperature of multiple light source channels, for example in dependence on a dimming level.

13 Claims, 7 Drawing Sheets

(58) Field of Classification Search
CPC ..... H05B 33/0872; H05B 33/0887; H05B 33/0845; H05B 33/0851; H05B 37/02; H05B 37/029; H05B 37/0842; Y02B 20/346; Y02B 20/46; Y02B 20/48
See application file for complete search history.

(56) References Cited

U.S. PATENT DOCUMENTS

| | | | | |
|---|---|---|---|---|
| 8,638,045 | B2 * | 1/2014 | Kunst | H05B 33/0815 315/291 |
| 8,823,285 | B2 * | 9/2014 | Chobot | H05B 33/083 315/210 |
| 9,781,793 | B2 * | 10/2017 | Yan | H05B 33/0818 |
| 9,844,113 | B2 * | 12/2017 | Yan | H05B 33/0824 |
| 2008/0030441 | A1 | 2/2008 | Callahan | |
| 2013/0015774 | A1 | 1/2013 | Briggs | |
| 2013/0043801 | A1 | 2/2013 | Kuwu | |
| 2016/0088697 | A1 | 3/2016 | Yan et al. | |

FOREIGN PATENT DOCUMENTS

| | | | |
|---|---|---|---|
| EP | 1748411 | B1 | 1/2007 |
| EP | 2760254 | A1 | 7/2014 |
| JP | 2004111104 | A | 4/2004 |
| WO | 2008041153 | A1 | 4/2008 |

* cited by examiner

METHOD OF CONTROLLING A LIGHTING ARRANGEMENT, A LIGHTING CONTROL CIRCUIT AND A LIGHTING SYSTEM

CROSS-REFERENCE TO PRIOR APPLICATIONS

This application is the U.S. National Phase application under 35 U.S.C. § 371 of International Application No. PCT/EP2017/057988, filed on Apr. 4, 2017 which claims the benefit of European Patent Application No. 16166560.9, filed on Apr. 22, 2016. These applications are hereby incorporated by reference herein.

FIELD OF THE INVENTION

This invention relates to the control of lighting systems, in particular multi-channel light systems. The multiple channels can for example provide color mixing and color temperature control, although other effects can also be obtained by using multiple light sources.

BACKGROUND OF THE INVENTION

There are various known multi-channel LED light sources. One possible arrangement makes use of different color channels in parallel. Each channel may for example independently provide a different color output. Alternatively, different LEDs may be provided in series, and bypass switches can be used to select which LEDs are activated, and thereby control the output color.

This invention relates in particular to the use of multiple channels in parallel.

Such systems face a major problem of limited space assigned for the drivers. For example, these systems may generate white light by driving red, green and blue LEDs independently. Note that in practice, a green LED may make use of a native blue LED and a green phosphor layer.

Systems of this type can also be used to generate white light with different color temperatures, for example having separate LED strings to generate cold white or warm white from a single luminaire. Alternatively, such systems can provide full output color control.

In addition, multi-channel LED drivers are also encountered in LED modules or LED luminaires in which different channels are used to generate separate beams for general lighting and task lighting.

In current implementations, the system requires separate drivers for the different LEDs of the module. For color tunable lamps for example, multiple LED channels are required in the driver to control the intensity of the different base colors. The intensity can be controlled by variation of the (continuous) currents or controlling the "on" time of the different colors using pulse width modulation (PWM) in each string. The PWM solution is preferred because of the more complicated requirements of current control.

Separate drivers may be needed for example as a result of the different load dependencies of the different channels. A problem arises because the available space for the light source drivers is fixed to meet the requirements of traditional light sources, which normally comprise one or at most two channels, with limited functions such as a dimming function. Multi-channel light sources with warm white and cool white channels, RGB channels, or more channels have a total peak power as well as a total space consumption which is the combination of the requirements for each channel. In order to compress the driver into a small space, basic performance has to be sacrificed, such as the power factor or efficiency, but this is generally not acceptable to the product designer. There is therefore a need to enable miniaturization of the driver circuits, without compromising the system performance.

FIG. 1 shows a conventional multi-channel lighting system driver circuit. Three LED loads 10,11,12 are shown, which may for example have three different color outputs. Each is driven by a respective driver 20,21,22 which essentially comprises a switch mode power supply (SMPS) or linear driver which implements PWM control. There is a global AC-DC converter 14, which includes power factor correction, and a global controller 16 which is remote to the actual light sources themselves. The global controller 16 provides commands to the local drivers 20,21,22 to control the operation of the LED loads.

This approach has a two-stage driver concept. One driver stage is to convert the mains voltage to an intermediate direct voltage and the other is to convert the intermediate voltage to a LED current. The multiple LED channels are then controlled independently from each other. For this two-stage driver, topologies are available to control multiple LED channels more or less independently from each other.

A single stage driver concept can be chosen to reduce costs. However, with such a topology, it is difficult to control multiple color LED channels. By-pass switching as used for color tunable lamps cannot be used because the buffer capacitor will be de-charged every time a switch is closed. With channels in parallel, the resulting system has high dependencies between the channels.

There are white-only lamps which implement color temperature adjustment as a function of dimming level. This dependency of color on the dimming level is termed a "dimtone" feature or function in the description below. This feature provides a color temperature which becomes warmer at lower dimming levels thereby mimicking the behavior of incandescent bulbs. However, with a single stage driver topology, which drives the full array of connected LEDs, it is difficult to control the multiple color temperature LED channels. If the multiple channels are in parallel, the resulting system will have high dependency between the channels.

Solutions that are used to implement the dimtone feature in non-connected LEDs cannot be used for connected lamps driven by a single driver stage.

Controlling the LED currents in the different parallel LED channels is important to set the correct color point in these types of tunable LED lamps. This problem becomes larger when also the dimming state of the lamp needs to be controllable separately from the color point.

There is therefore a need for a method to properly control both a single stage driver as well as the PWM switches of individual LED channels to ensure that the correct color point and dimming state (i.e. brightness level) can be set.

US 2016/0088697 A1 discloses a circuit for driving a light source including a power converter coupled between a power source and the light source, and a controller coupled to the power converter. The power converter receives power from the power source and provides a regulated power to the light source. The controller receives a conduction status signal indicating a conduction state of a dimmer coupled between the power source and the power converter, and adjusts the brightness of the light source based on the conduction status signal. The controller also receives an operation indicating signal indicative of operation of an ON/OFF switch coupled to the dimmer, and adjusts color temperature of the light source based on the operation indicating signal.

SUMMARY OF THE INVENTION

The invention is defined by the claims.

According to examples in accordance with an aspect of the invention, there is provided a lighting control circuit for controlling a lighting arrangement comprising a plurality of strings connected in parallel with each other, the plurality of strings comprising a first string and a second string, the first string comprising a first light source, the second string comprising a second light source and a disable switch, the second light source being connected in series with the disable switch, the first light source and the second light source having different color points, the lighting control circuit further comprising:

a current driver for delivering a required average output current to the lighting arrangement, the current driver having an input for receiving a current driver setting;

a controller for controlling a duty cycle of the disable switch thereby to control a color or color temperature setting of the lighting arrangement, and for providing the current driver setting to the current driver thereby to control a dimming level of the lighting arrangement, wherein the controller is adapted to derive the required average output current from the current driver based on the controlled duty cycle and the dimming level of the lighting arrangement, and to derive the current driver setting from the required average output current, such that each string of the plurality of strings has a light source utilization factor, wherein the sum of the light source utilization factors is larger than 100%.

This lighting control circuit is arranged to deliver a controllable current to a lighting arrangement, wherein the controllable current is determined by characteristics of the lighting arrangement. The characteristics of the lighting arrangement can be derived from a required duty cycle of a disable switch, thereby controlling a color or color temperature setting. The controller uses the controlled duty cycle and a dimming level of the lighting arrangement to derive a required average output current from the current driver. The required average output current is consequently chosen such that the sum of the utilization factors of the light sources of the lighting arrangement is larger than 100%.

The utilization factor of a light source is the ratio of the time wherein the light source is emitting light and the time wherein the light source is not emitting light. When a light source is turned on 70% of the time, e.g. caused by the duty cycle of a disable switch, the utilization factor is 70%. When one light source has a utilization factor of 70% and another light source has a utilization factor of 60%, the sum of the utilization factors is 130%.

This control circuit delivers a controllable current to a lighting arrangement. Thus a single stage driver may be used. In order to enable an adjustable output color or color temperature, at least two light sources are used, and at least one of these has an associated disable switch to implement PWM control. Thus, the color or color temperature may for example be controlled in dependence on a dimming level, but without requiring separate and independent control of the light sources.

Based on the required PWM setting for the selected color or color temperature, and the dimming level, the average current required from the current driver can be determined. This can be defined by the PWM duty cycle of a control signal for controlling the current driver. Furthermore, based on the knowledge of the characteristics of the light source and other components in the light source circuit, the voltages arising in the circuit at different phases of the PWM signal can also be derived. This in turn enables the average voltage expected at the output of the current driver to be determined. The current driver can thus be set to a control setting which accurately delivers the required output to the lighting arrangement.

The current variation due to the PWM control applied to the color adjustment light source (or sources) is taken into account when determining the total driver current. Thus, the required PWM settings of the adjustment light source are used to derive the overall current level needed. However, the voltage which will be present at the output is also taken into account so that the correct control settings can be applied to the current driver, in particular so that the required average voltage can be maintained by a buffer capacitor at the output of the current driver. The different light sources may be considered to be different parallel channels, and a single drive voltage level is present at the driver at any one time.

There may be more than two light sources all connected in parallel, for example in parallel with a common buffer capacitor.

The first light source may be considered to be a main light source and the second light source may be considered to be a color adjustment light source. There may be multiple color adjustment light sources.

The circuit may be implemented only with a switch (and optionally also a resistor) associated with the second (e.g. color adjustment) light source. More complicated implementations are however possible to give additional control options.

A microprocessor may be used to implement the control algorithm, and this reduces costs in the electronics required to drive the additional color adjustment channel. The use of a microcontroller gives flexibility in choosing the color temperature, for example as function of the dimming level.

In this way, the color adjustment channel or channels may function as dimtone channels implementing a color temperature change as a function of the set dimming level. However the circuit may be used to implement other color adjustments and may for example have RGB lighting channels as first, second and third light sources, or it may have multiple white channels of different color temperature.

In the case of an RGB system, each cannel will have a disable switch so that the RGB channels may have their PWM setting adjusted independently. However, the channels remain only partially independent in that they share the current delivered by the driver and share the same voltage drop.

A resistor may be provided in series with the second light source. Since a current is delivered to the light sources as a single unit, this resistor may be used to control the division of current as between the first light source and the second light source, thereby tuning the way the second (e.g. color adjustment) light source influences the overall light output.

A second disable switch may also be provided in series with the first light source, wherein the controller is further for controlling the duty cycle of the second disable switch.

By controlling the first light source switch with a PWM signal (as well as the second light source) the system can be made compatible with a coded light feature, which gives a coded flickering light output.

The circuit may be for controlling a lighting arrangement comprising a set of at least three light sources comprising a main light source as the first light source, a color adjustment light source as the second light source and a further color adjustment light source as the third light source all in parallel, and it may further comprise a third disable switch in series with the further color adjustment light source, wherein the controller is further for controlling the duty cycle of the third disable switch.

In this way, there may be three (or more) lighting channels. The invention can be extended to systems with multiple channels to make low cost implementations of tunable white lamps or color tunable lamps. A resistor may also be provided in series with the third light source for current balancing purposes.

The system may implement color change as a function of dimming level, so that a dimming level received as input is thus used to control the overall light output level (a standard dimming function) and at the same time control the output color or color temperature.

The invention also provides a lighting circuit comprising:

a lighting control circuit as defined above;

the first light source; and the second light source, in parallel with the first light source and the first and second light sources having different color points.

The first light source may be a white light source with a first color temperature and the second (e.g. color adjustment) light source may be a white light source with a second, different, color temperature. This color temperature may be lower (i.e. a warmer color) and it may then be used proportionately more during dimming to implement a dimtone function.

A third light source may be provided (which functions as a further color adjustment light source), wherein the third light source is a white light source with a third, different, color temperature. It may for example be higher than the color temperature of the main light source. This enables the system to be controllable between daylight white and warm white settings, for example.

The invention also provides a method of controlling a lighting arrangement comprising a plurality of strings connected in parallel with each other, the plurality of strings comprising a first string and a second string, the first string comprising a first light source (380), the second string comprising a second light source (400;500) and a disable switch (40*a*;50*a*), the second light source (400;500) being connected in series with the disable switch (40*a*;50*a*), the first light source (380) and the second light source (400;500) having different color points, the method comprising:

receiving a color or color temperature setting and a dimming level;

controlling a duty cycle of the disable switch (40*a*;50*a*) based on the color or color temperature setting;

deriving a required average output current (Iconverter) from a current driver (36) based on the controlled duty cycle (PWM_dimtone) and the dimming level of the lighting arrangement;

deriving a current driver setting (PWM_current_setpoint) from the required average output current (Iconverter) such that each string of the plurality of strings has a light source utilization factor, wherein the sum of the light source utilization factors is larger than 100%.

This method comprises delivering a controllable current to a lighting arrangement, wherein the controllable current is determined by characteristics of the lighting arrangement. The characteristics of the lighting arrangement can be derived from a required duty cycle of a disable switch, thereby controlling a color or color temperature setting. The controller uses the controlled duty cycle and a dimming level of the lighting arrangement to derive a required average output current from the current driver. The required average output current is consequently chosen such that the sum of the utilization factors of the light sources of the lighting arrangement is larger than 100%.

The method may be used to control a lighting arrangement comprising a set of at least three light sources (each with different color points) comprising a main light source as the first light source, a color adjustment light source as the second light source and a further color adjustment light source as the third light source all in parallel, wherein the method further comprises controlling the duty cycle of a third disable switch in series with the third light source.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting control circuit for controlling a lighting arrangement comprising a plurality of strings connected in parallel with each other. The plurality of strings comprises a first string and a second string. The first string comprises a first light source, and the second string comprises a second light source. In an example, the first and second light sources are a main light source and a color adjustment light source, respectively. A current driver is used to deliver a drive current to the lighting arrangement. The second string further comprises a disable switch connected in series with the second light source, and the duty cycle of the switch is controlled as well as the overall drive current setting thereby to control the color or color temperature setting and/or dimming level of the lighting arrangement.

The controller derives the required average output current and the expected average output voltage from the current driver based on the determined duty cycle and the dimming level, and then derives the current driver setting. In this way, the current driver is accurately controlled to deliver the required output.

In this way, a single stage driver may be used to enable the color or color temperature to be controlled, for example in dependence on a dimming level.

Figure 1:
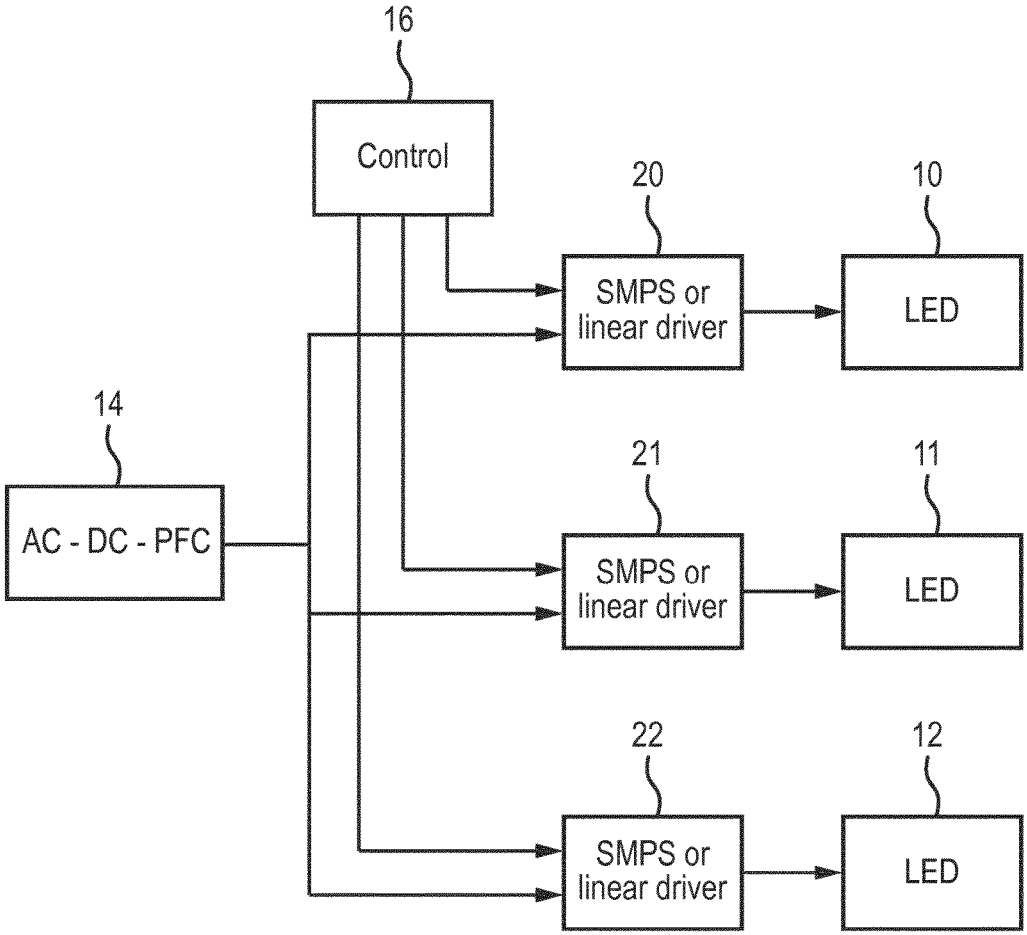
FIG. 1 shows a known lighting control architecture for driving multiple lighting channels.
Figure 2:
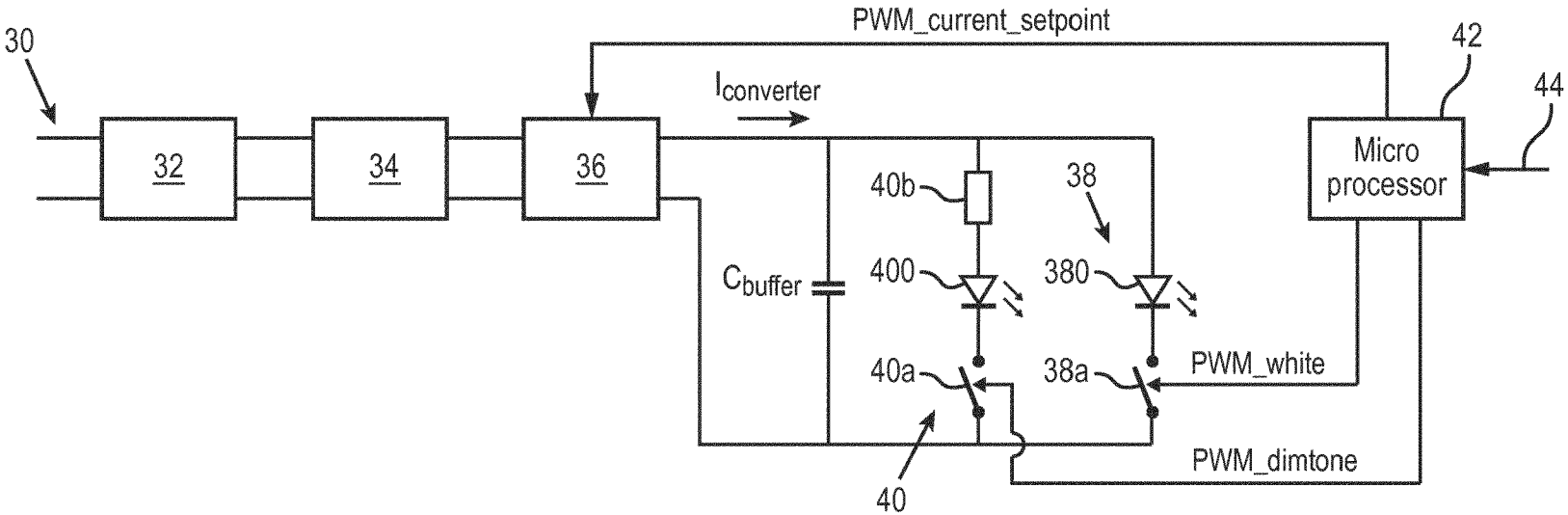
FIG. 2 shows a first example of lighting circuit.

FIG. 2 shows a first example of lighting circuit, which has been proposed by the applicant, but not published at the time of filing of this application.

The circuit receives a mains input 30 which is provided to an electromagnetic interference (EMI) filter 32. The mains signal is rectified by rectifier 34 and then provides the DC power to a current regulating driver 36 which may be considered to function as a controllable current source. The driver 36 is of conventional design and may for example comprise a current regulating switch mode power converter. It delivers an output current converter to its load.

Note that the invention may instead be applied to a DC powered lighting circuit.

In this example, the load circuit has a large buffer capacitor Cbuffer to suppress the flicker caused by the mains frequency. The load comprises an LED configuration. The basic LED configuration consists of a main channel 38 typically (but not necessarily) with a string or multiple strings of white LEDs 380. These LEDs function as the main light source of the lighting circuit, and they have a color temperature which matches the desired main color temperature of the overall product. The main channel 38 is an example of a first string.

A color adjustment light source forms part of an auxiliary color adjustment light source channel 40. This has LEDs 400 with a different color point in order to tune the perceived output color of the product. The auxiliary color adjustment light source channel 40 is an example of a second string. The main channel and the auxiliary color adjustment light source channel are two strings connected in parallel.

In one example, this enables the dimtone functionality described above to be enabled, by which the light output color varies as a function of dimming level. Thus, the color adjustment light source channel 40 in this case defines a dimtone channel. The LEDs of the channel 40 may have a warmer light output i.e. lower color temperature.

The dimtone channel 40 has a series switch 40*a* to which a dimtone switch control signal PWM_dimtone is applied. In the example shown, the main channel 38 also has a series switch 38*a* to which a main switch control signal PWM_white is applied. This switch is however optional.

The (or each) series switch is generally implemented as a MOSFET transistor, and it can be used to switch the channel on or off. In the dimtone channel 40, an additional series resistor 40*b* is provided to limit the current in the dimtone channel 40. This resistor is used so that a desired voltage remains across the LEDs of the channel 40, and it is required because the channels are not independent. Their connection in parallel gives rise to the constraint that the voltage across each channel is the same, namely the voltage across the buffer capacitor Cbuffer.

This resistor may however not be required if the particular LED configuration is such that the required voltage operating point for all the channels is the same.

The circuit has a microprocessor 42 that receives a desired dimming level and/or output color as an external input 44. Based on this external input, the PWM control signal PWM_dimtone is generated, and the PWM signal PWM_white if there is also switched control within the main channel.

In a basic implementation, the external control signal is simply a dimming level and the microprocessor implements a fixed relationship between the dimming level and the output color. In a more advanced implementation, the relationship can be programmed. In further embodiments, the external input 44 may be used to set a color point or color temperature independently of dimming level, or it may be used to implement a dimming function without a change in color point or temperature.

The switches 38*a*, 40*a* are controlled with individual pulse width modulated (PWM) control signals generated by the microprocessor. The set point of the driver (functioning as a current source) can also be controlled by the microprocessor, with an analogue signal, or with a PWM signal as shown in this example (PWM_current_setpoint).

To the human eye, the color of the emitted light is a mixture of the two base colors. The output color can be tuned by tuning the ratio between the two base colors. This can be done by controlling the duty cycles of the series switches in combination with the current set point of the driver. Although there is a strong coupling between the channels (due to the buffer capacitor), the three duty cycles can be chosen such that the desired output color is achieved providing that it within the gamut of the installed LEDs (flux and color).

The LED channels share the same forward voltage. For each point of operation, the string voltage will be more or less constant (ignoring the remaining variation due to the mains frequency and the small variations due to the PWM frequencies). Each channel has a forward current (when the switch is closed) which corresponds to a peak flux. The average flux of the channel is simply the duty cycle of the switch multiplied by the peak flux.

The current through the main channel can be tuned by choosing a proper value for the duty cycle of the white channel switch 38*a*. For the auxiliary channel or channels, the current can be tuned by choosing a proper value for the series resistor as well as the PWM control.

As mentioned above, the switch 38*a* in the main channel is optional. Without it, the system selectively removes current from the main channel and diverts it to the auxiliary channels, but there is continuous current flow through the main channel. With the switch in the main channel, a compromise between duty cycle and brightness can be found, for example for more efficient operation.

In addition, the provision of switches in all channels means the system is able to generate a coded light output, according to which messages are encoded by controlled flickering of the light output.

Light sources are applied in lighting systems consisting of a large number of light sources. Several parameters of the light sources can be varied such as the light intensity, light color, light color temperature and even light direction. By varying and controlling these parameters of the different light sources, a light designer or user of the system is enabled to generate lighting scenes. The use of a coded light output can be used to enable a more intuitive and simpler control of the light sources, and to create scenes. The coded light involves the embedding of invisible identifiers in the light output for example based on unique modulation of the light output.

These light source identifiers, also referred to as codes, allow for the identification and strength estimation of the individual local illumination contributions. This can be applied in light control applications such as commissioning, light source selection and interactive scene setting. These applications have use in, for example, homes, offices, shops and hospitals. The light source identifiers hence enable a simple and intuitive control operation of a light system, which might otherwise be very complex.

The coding can be based on setting a desired coded light frequency as the PWM frequency or by setting the PWM frequency to a (multiple) of the desired symbol rate and by modulating the duty cycle. The switch in the main channel is only necessary when coded light is used.

Figure 3:
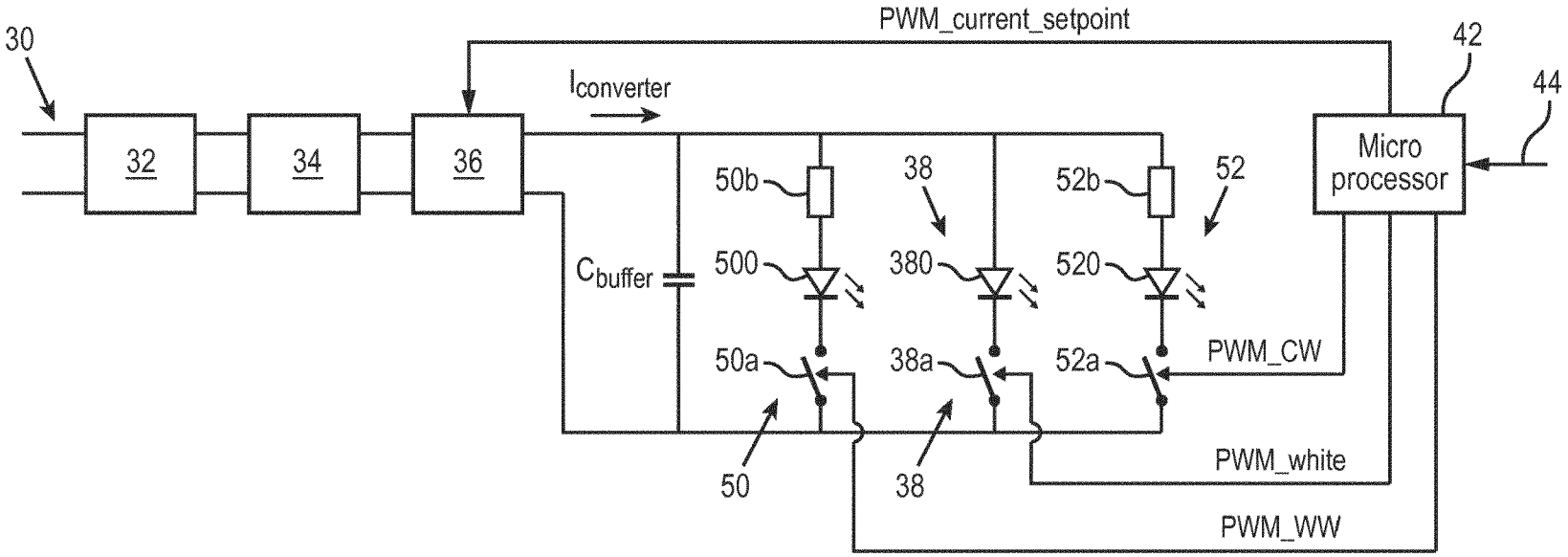
FIG. 3 shows a second example of lighting circuit.

FIG. 3 shows another arrangement proposed by the applicant, but again not published at the time of filing of this application.

As shown in FIG. 3, the concept can be extended to cover a plurality of parallel strings containing more than two channels. The same reference numbers are used as in FIG. 2 to denote the same components.

In addition to the main channel 38, there is a first color adjustment channel 50 and a further (second) color adjustment light channel 52 both in parallel with the main channel.

The channel 50 has a series switch 50*a* and resistor 50*b* and the LEDs 500 have a warm white output (low color temperature). The channel 52 has a series switch 52*a* and resistor 52*b* and the LEDs 520 have a cool white output (high color temperature).

As in the example of FIG. 2, the main channel also has a switch 38*a* but this is again optional.

The configuration of FIG. 3 can be used to create a tunable white product using a low-cost single stage driver. It combines one main channel and two auxiliary channels: a warm white channel and a cool white channel. The switches for all channels are controlled by the microprocessor 42.

For target color points that lie between 'warm white' and 'white', the main channel is used in combination with the warm white auxiliary channel. For color points that lie between 'white' and 'cool white' the main white channel is used in combination with the cool white auxiliary channel.

The same approach may be used to provide a full color output light based on RGB channels, or there may be even more channels where white LEDs are combined with RGB LEDs.

When designing a light system using the control system described above, some considerations are needed:

The dissipation in the series resistors 40*b*, 50*b*, 52*b* may impact the efficacy and the thermal design of the system. This can be prevented by carefully choosing the LED strings such that their forward voltages are not too different.

The peak current through the channels should not become arbitrarily small in a real life system. If the current becomes too small, the output flux and output color of the system will become too sensitive for LED production variations. This problem can be circumvented by choosing a small duty cycle for the channel when a small average flux is requested thereby keeping the peak current at an acceptable level.

The signal quality for a coded light system using frequency modulation depends on the duty cycle of the different channels. Duty cycles close to 50% are optimal. The system has some degrees of freedom to be able to optimize the configuration for the coded light signal quality.

The examples above show parallel channels, so that there is a common string voltage, and the overall current delivered is shared between the channels. The controlled channels have a series switch. A parallel bypass switch may however also be used to bypass some or all of the LEDs in a channel.

As explained above the controller receives an external input for controlling the dimming level and/or the color point. The control interface for receiving this command may be a DALI interface or a Zigbee wireless interface. A dimming interface may instead use a 1-10V protocol (IEC 60929-E).

As explained above, the microprocessor 42 translates the color temperature and brightness commands it receives as external input 44 into different PWM signals. One PWM signal is for the current source 36 and there is one PWM signal for each LED channel.

In order to set the right color point and brightness level, the behavior of the different LED channels needs to be predictable.

This predictability may be ensured by maintaining the same peak current per channel during the on-state of the PWM signal. When the behavior of the LEDs is known, the resulting color point is obtained by calculating the result of mixing the light from multiple channels. Different color points will have different PWM combinations.

A difficulty in the topology of FIG. 3 is that the current supplied by the converter 34,36 is divided over the different LED channels. While the peak current in all the channels is maintained, the average current that needs to be supplied by the current source depends on the actual PWM signals in the different channels. The output voltage of the current source also depends on the PWM combinations.

This invention relates to an approach for finding the correct set point of the current source 36, and it provides a backwards calculation in order to find the correct set point.

Figure 4:
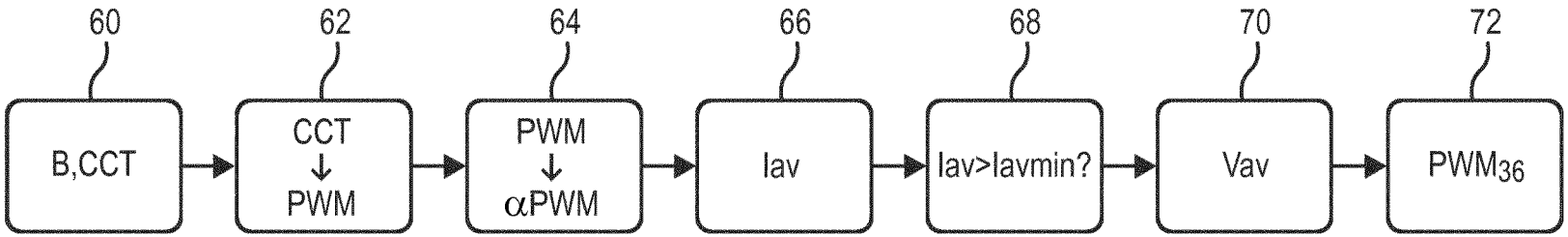
FIG. 4 shows a method of controlling the current driver.

FIG. 4 shows the method.

In step 60, the brightness (B) and color point (CCT) are received as the external input 44.

In step 62, the color point (CCT) is translated into the required PWM combination for the different colors. In the example shown, there are three PWM signals for warm white, white and cool white (PWM_WW:PWM_white:PWM_CW). In particular, the PWM combination is obtained (for example from a look-up table) for the different channels at the maximum flux the lamp can deliver at that specific color point. At this maximum flux, one of the channels will have a PWM duty cycle of 1, i.e. one channel will be permanently on, so that the brightness cannot be increased further while maintaining the same duty cycle ratio.

The system has thus at this stage found the PWM combination at the maximum flux that can be delivered.

In step 64, the PWM signals are linearly scaled for example by a factor α based on the appropriate dim level. For example, if the dim level is 50% and the PWM combination is 1:0.5:0 at the maximal flux for this color point, then the resulting PWM combination will be 0.5:0.25:0.

In step 66, the average current needed at this PWM combination, i.e. at this brightness level, is obtained. This is done using the following formula:

$$I_{avg,driver} = \sum_{n=1}^{3} \delta_{PWMn} * I_{peak,PWMn}$$

$\delta_{PWNn}$ is the PWM duty cycle for channel n and $I_{peak,PWMn}$ is the peak current for that channel. This average driver current $I_{avg,driver}$ is shown simply as lay in FIG. 4.

In step 68, it is determined if the average current lay is above a minimum Iavmin which can be regulated by the converter. If it is not above this level, then it is clipped to a fixed level.

Because of non-ideal current source behavior the average output voltage Vav of the current source is determined as well, in step 70. Using the LED voltages and calculating the bias voltages from the resistors 50*b* and 52*b* based on the peak currents, the average voltage that needs to be maintained over the different LED channels is determined.

In step 72, the determined average current and voltage are used to look-up the appropriate set point for the current source, PWM_current_setpoint (shown in FIG. 4 as $PWM_{36}$). This is selected so that the average voltage can be maintained by the buffer capacitor (Cbuffer).

In one example, a look-up table may be used which represents the voltage-current behavior of the power converter.

Figure 5:
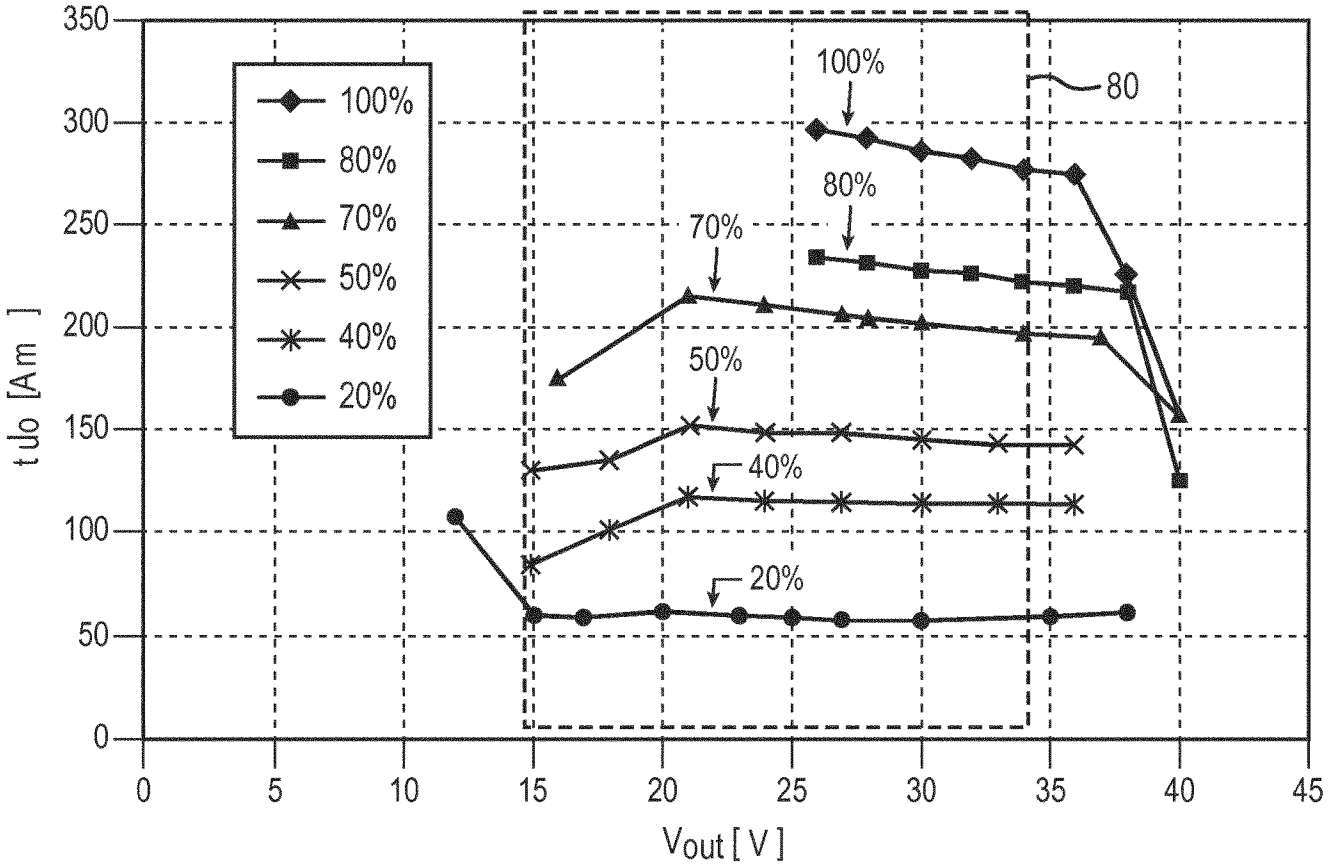
FIG. 5 shows an example of a set of current-voltage characteristics for different dimming levels.

FIG. 5 shows a set of relationships between output current (y-axis) and output voltage (x-axis) for different dimming levels of 20%, 40%, 50%, 70%, 80% and 100% applied to the power converter. The region 80 is the operating region of the converter. Below the lowest voltage of the region 80 the LEDs are turned off. Above the highest voltage of the region 80, an overvoltage protection system kicks in. Of course, different power converters will have different operating voltage ranges and different current-voltage characteristics.

From the calculation with the peak currents (e.g. string 38*a*)) and the biasing resistors, the average voltage can be calculated. Note that the output voltage is not controlled directly, but it is instead the result of current flowing though the load which is present at any particular time.

Only one string calculation is necessary because it can be assumed that the capacitor voltage will not change due to the PWM switching behavior. The dimming level to be applied to the converter (PWM_current_setpoint) is then determined from the look up table (as part of step 72 in FIG. 4).

The switch mode switching frequency is in the order of 60-100 kHz, whereas the PWM frequencies (PWM_CW, PWM_white and PWM_WW) are for example around 1 kHz. The control loop of the set point for the converter is slower, for example of the order of 400 Hz.

In this way, a model of the single stage converter is used to predict the PWM duty cycle of the converter.

As explained above, one suitable implementation of the control algorithm is for a tunable white lamp. The lamp can for example change the color of the light output between 2200K white light and 6500K white light. In order enable this with a minimal error in the appropriate white colors, the three white channels may be chosen at 2200K, 2700K and 6500K. The middle value may be different, for example 3000K to enable the same overall adjustment range.

However, the invention can be applied to all types of multi-channel light system which require at least two channels to drive the light sources, such as for color mixing or for correlated color temperature (CCT) light sources.

The system makes use of a controller. Components that may be employed for the controller include, but are not limited to, conventional microprocessors, application specific integrated circuits (ASICs), microcontrollers (MCUs), and field-programmable gate arrays (FPGAs). In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

Thus, this invention also includes a computer program comprising code means which is adapted, when run by the processor, to implement the control method as described above.

Figure 6:
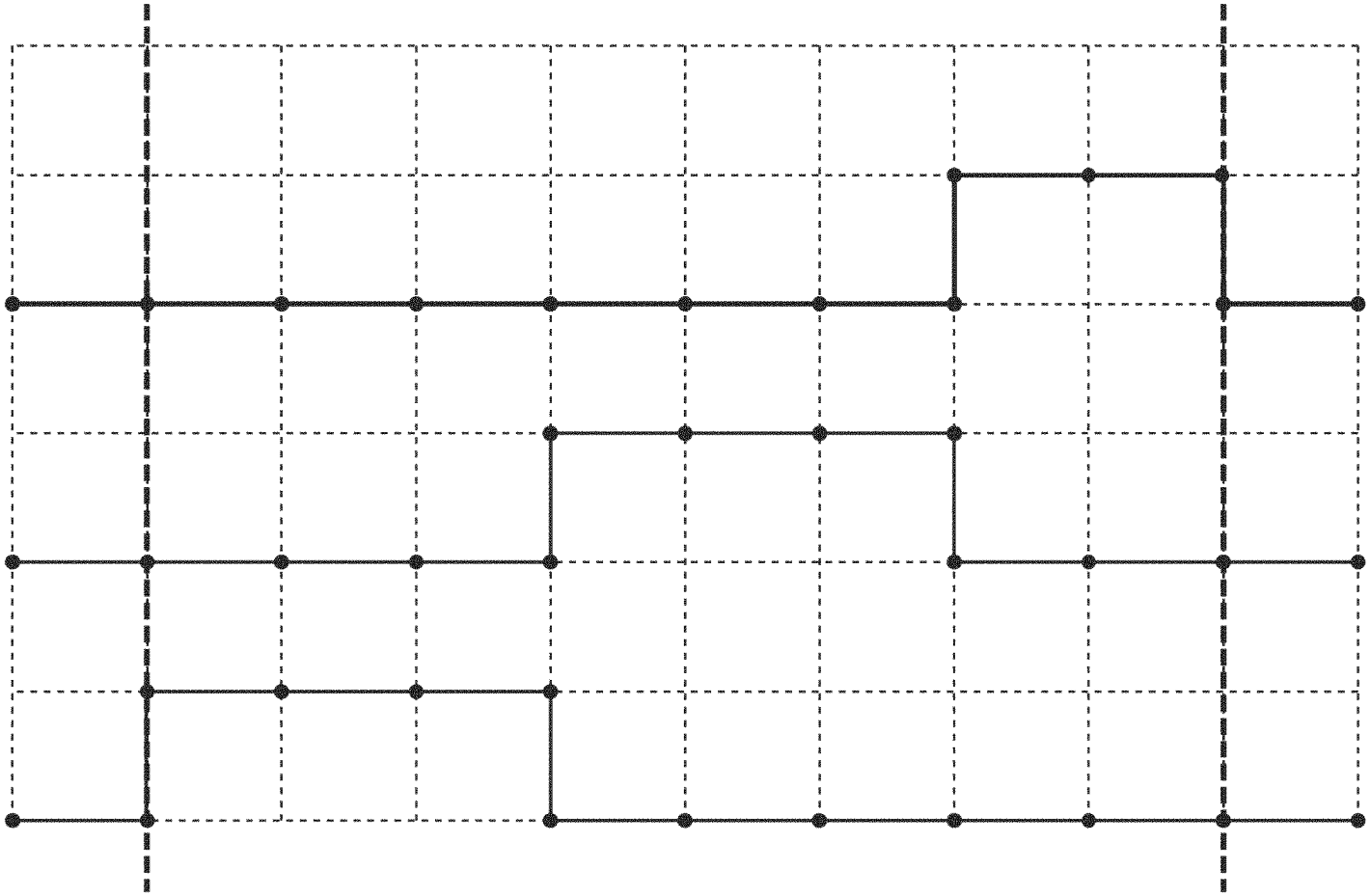
FIG. 6 shows an example of a light source utilization factor of a known lighting control circuit.

FIG. 6 shows a graph representing a period of time of three PWM signals. The dashed lines represent one period of time. The PWM signals are generated by a known controller controlling the switches in the channels to create a desired light output. The light sources each may have different color points to each other. In the example illustrated in FIG. 6, the first channel, at the bottom of the figure, is on during 37.5% of the period of time. The second channel, in the middle of the figure, is on during 37.5% of the period of time and the third channel, at the top of the figure, is on 25% of the period of time, so that the sum of the light source utilization factors of the three channels is 100%. The channels are activated consecutively so that the duty cycles of the channels do not overlap with each other. For such a situation, the sum of the light source utilization factors of the three channels can never exceed 100%.

Figure 7:
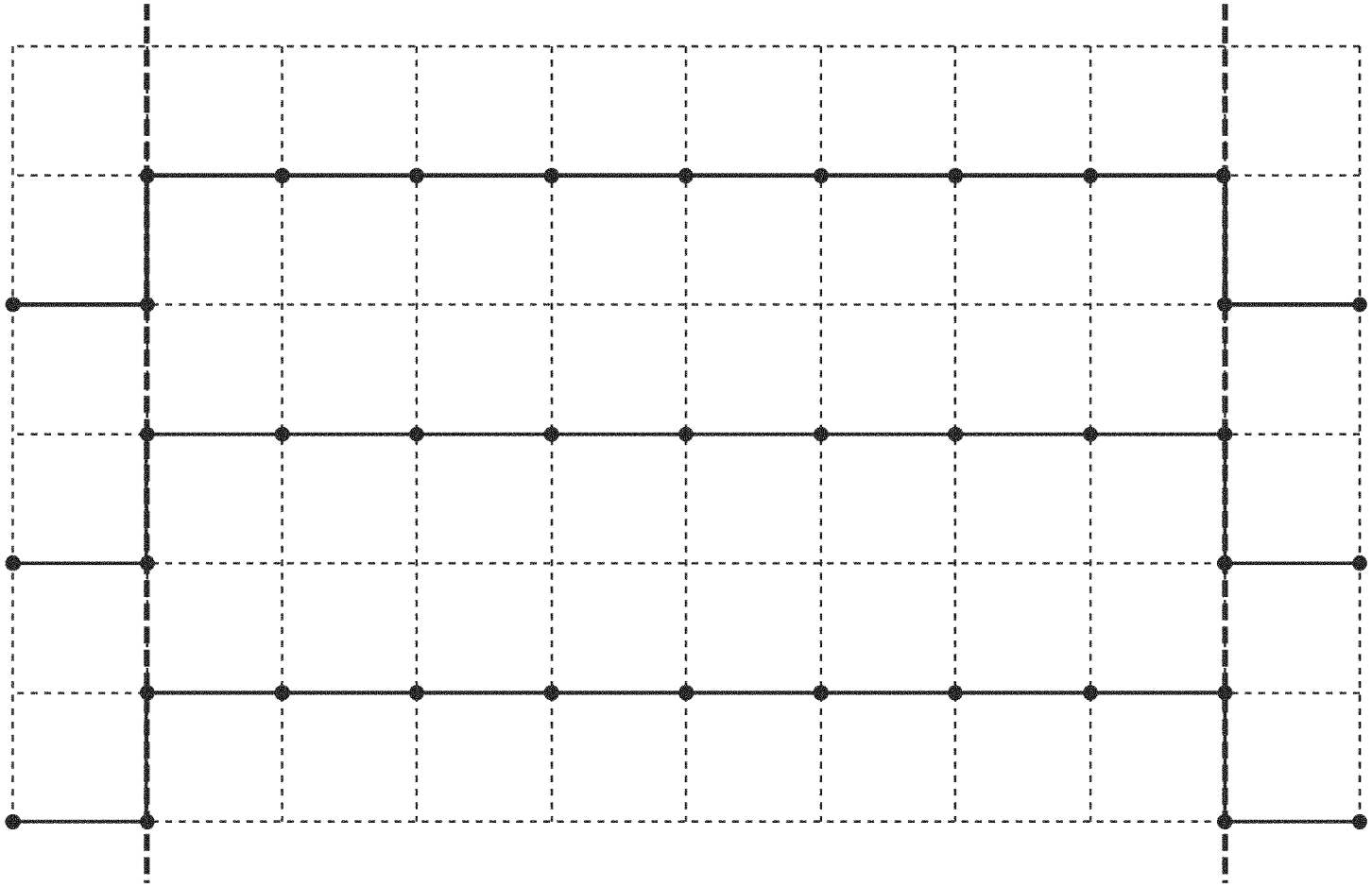
FIG. 7 shows an example of a light source utilization factor of a lighting control circuit according to the proposed invention.

FIG. 7 shows a graph representing a period of time of three PWM signals. The dashed lines represent one period of time. The PWM signals are generated by the controller 42 and control the switches in the channels to create a desired light output. The light sources each may have different color points to each other. In the example illustrated in FIG. 7, each channel is on during the full period of time, so that the sum of the light source utilization factors of the three channels is 300%. A result of this large utilization factor is that in this example, with only ⅓ of the total current amplitude a similar light output can be generated compared to a known light source.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting control circuit for controlling a lighting arrangement comprising a plurality of strings connected in parallel with each other, the plurality of strings comprising a first string and a second string, the first string comprising a first light source, the second string comprising a second light source and a disable switch, the second light source being connected in series with the disable switch, the first light source and the second light source having different color points, the lighting control circuit comprising:

a current driver for delivering a required average output current (Iconverter) to the lighting arrangement, the current driver having an input for receiving a current driver setting (PWM_current_setpoint) to deliver a required output to the lighting arrangement;

a controller comprising an external input for deriving a desired output color and/or a desired dimming level, and being arranged for:

controlling the disable switch by translating the desired output color into a required duty cycle of the disable switch (PWM_dimtone) to obtain different colors;

linearly scaling the duty cycle of the disable switch (PWM_dimtone) based on the desired dimming level;

determining the required average output current (Iconverter) based on the scaled duty cycle of the disable switch (PWM_dimtone);

determining an average output voltage required across the plurality of strings (Vav); and determining the current driver setting (PWM_current_setpoint) based on the determined required average output current (Iconverter) and the determined average output voltage (Vav).

2. A lighting control circuit as claimed in claim 1, further comprising a resistor in series with the second light source.

3. A lighting control circuit as claimed in claim 1, further comprising a second disable switch in series with the first light source, wherein the controller is further for controlling the duty cycle of the further switch.

4. A lighting control circuit as claimed in claim 3, wherein the plurality of strings further comprises a third string, the third string comprising a third light source, the first light source being a main light source, the second light source being a color adjustment light source, and the third light source being a further color adjustment light source, wherein the third string further comprises a third disable switch being connected in series with the third light source, wherein the controller is further for controlling the duty cycle of the third disable switch.

5. A lighting control circuit as claimed in claim 1, wherein the color or color temperature setting and the dimming level are both derived from a dimming setting.

6. A lighting circuit comprising:

a lighting control circuit as claimed in claim 1; and the lighting arrangement.

7. A lighting circuit as claimed in claim 6, wherein the first light source is a white main light source with a first color temperature and the second light source is a white color adjustment light source with a different, second color temperature.

8. A lighting circuit as claimed in claim 7, wherein the plurality of strings further comprises a third string, the third string comprising a third light source, the third light source being a white further color adjustment light source with a different, third color temperature.

9. A method of controlling a lighting arrangement comprising a plurality of strings connected in parallel with each other, the plurality of strings comprising a first string and a second string, the first string comprising a first light source, the second string comprising a second light source and a disable switch, the second light source being connected in series with the disable switch, the first light source and the second light source having different color points, the method comprising:

receiving a color or color temperature setting and a dimming level;

controlling a duty cycle of the disable switch based on the color or color temperature setting;

linearly scaling the duty cycle of the disable switch (PWM_dimtone) based on the desired dimming level;

deriving a required average output current (Iconverter) from a current driver based on the scaled duty cycle (PWM_dimtone);

determining an average output voltage required across the plurality of strings (Vav);

deriving a current driver setting (PWM_current_setpoint) from the required average output current (Iconverter and the determined average output voltage (Vav).

10. A method as claimed in claim 9, wherein the first string further comprises a second disable switch connected in series with the first light source, and wherein the method further comprises controlling the duty cycle of the second disable switch to provide a coded light output.

11. A method as claimed in claim 10, wherein the plurality of strings further comprises a third string, the third string comprising a third light source, the first light source being a main light source, the second light source being a color adjustment light source, and the third light source being a further color adjustment light source, wherein the third string further comprises a third disable switch being connected in series with the third light source, wherein the method further comprises controlling the duty cycle of the third disable switch.

12. A method as claimed in claim 9, wherein the first light source is a white main light source with a first color temperature and the second light source is a white color adjustment light source with a second, higher, color temperature.

13. A method as claimed in claim 9, comprising deriving the color or color temperature setting and the dimming level from a dimming setting.

* * * * *